US005667357A

United States Patent [19]

Buse et al.

[11] Patent Number: 5,667,357

[45] Date of Patent: Sep. 16, 1997

[54] BEARING AND SEAL PERCOLATOR FOR A CENTRIFUGAL PUMP

[75] Inventors: Frederic W. Buse, Allentown; Francis W. Thamarus, Palmerton, both of Pa.

[73] Assignee: Ingersoll-Dresser Pump Company, Liberty Corner, N.J.

[21] Appl. No.: 606,719

[22] Filed: Feb. 27, 1996

[51] Int. Cl.[6] ..... F04D 29/08

[52] U.S. Cl. ..... 415/110; 415/56.1

[58] Field of Search ..... 415/110, 111, 415/112, 56.1, 1, 56.6

[56] References Cited

U.S. PATENT DOCUMENTS

| | | | |
|---|---|---|---|
| 790,795 | 5/1905 | Degen | 415/113 |
| 1,026,101 | 5/1912 | Marsh | 415/113 |
| 1,382,665 | 6/1921 | Myers . | |
| 1,755,217 | 4/1930 | Jacobsen . | |
| 1,946,212 | 2/1934 | Jacobsen | 103/113 |
| 2,190,670 | 2/1940 | Mann | 415/113 |
| 2,466,812 | 4/1949 | Jacobsen | 415/56.5 |
| 5,088,891 | 2/1992 | Brown et al. | 415/176 |
| 5,131,806 | 7/1992 | Taga | 415/112 |
| 5,163,812 | 11/1992 | Klaus et al. | 415/171.1 |
| 5,248,245 | 9/1993 | Behne et al. | 415/110 |

FOREIGN PATENT DOCUMENTS

| | | | |
|---|---|---|---|
| 622381 | 5/1927 | France | 415/56.6 |

*Primary Examiner*—John T. Kwon
*Attorney, Agent, or Firm*—Robert F. Palermo

[57] ABSTRACT

A percolator system for providing fluid flow to bearings and seals supporting a shaft, on which is mounted an impeller having pumping vanes, disposed within a housing of a centrifugal pump, during intermittent dry running periods, the pump having a vertical upwardly directed discharge nozzle, includes a chamber having a lower end attached to the discharge nozzle and an upper end attached to a discharge pipe, the chamber having an inside diameter greater than an outside diameter of the discharge nozzle, and the chamber further having an internal percolator pipe at least equal in diameter to the discharge nozzle and extending from the nozzle to a height less than the height of the chamber such that fluid coming from the nozzle overflows into the chamber. A fluid return port near the lower end of the chamber has one end of a return tube attached. The other end of the return tube is attached to an external injection connection which connects with a passage within the housing for conducting fluid from the injection connection to the bearings and seals and thence to a torus of liquid at a volute in the housing.

4 Claims, 2 Drawing Sheets

BEARING AND SEAL PERCOLATOR FOR A CENTRIFUGAL PUMP

BACKGROUND OF THE INVENTION

This invention relates generally to centrifugal pumps and more particularly to centrifugal pumps having intermittent dry running capability provided to a product lubricated bearing or to mechanical seal(s) by a fluid percolation system.

At high rotating speeds at which centrifugal pumps operate, product lubricated bearings or mechanical seal(s) (henceforth bearings and seals) must be lubricated at all times to reduce friction and to carry away heat generated by the friction which persists. With perfect lubrication, there would be no friction and, consequently, no heat build-up to be carried away. Since many fluids, such as water have limited lubricity, and since those same fluids often dissolve lubricating oils and greases, it is fairly common to use the pumped (or working) fluid to lubricate the bearings and seals of a centrifugal pump. Because of the limited lubricity of many pumped fluids, it is common to use very hard materials in pumps lubricated by the pumped fluid. This arrangement is generally quite satisfactory, except that occasionally the fluid (or liquid) source becomes empty while pumping, and the pump runs dry for a short time. This can lead to a very rapid temperature rise due to frictional heating and can destroy bearings and seals in a short time.

Product lubricated pump bearings and seals typically cannot be safely operated under dry system conditions; because the materials from which they are made are not sufficiently lubricious and because they are not able to withstand the temperatures generated by such operation. Bearings and seal surfaces are often made of silicon carbide, because it is hard and chemically resistant and is therefore tolerant of suspended particles and corrosive liquids; however, silicon carbide fails almost instantaneously without lubrication. To provide for occasional dry running, bearings have been made from carbon and/or graphite, which can withstand approximately 3–5 minutes of dry running; but these materials are soft and wear rapidly when pumping fluids which contain particles. Various grades of silicon carbide with graphite, polymers, or other materials have been offered, but none has a dry run capability of more than 5–10 minutes. Similarly, the sealing surfaces of mechanical seals require continuous vapor flow across the seal faces to prevent failure which could result from dry running.

The foregoing illustrates limitations known to exist in present centrifugal pumps. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a percolator system for providing fluid flow to bearings, supporting a shaft, and seals, on which is mounted an impeller having pumping vanes, disposed within a housing of a centrifugal pump, during intermittent dry running periods, said pump having a discharge nozzle; the percolator including a chamber having a lower end attached to the discharge nozzle and an upper end attached to a discharge pipe, the chamber having an inside diameter greater than an outside diameter of the discharge nozzle, and the chamber further having an internal percolator pipe at least equal in diameter to the discharge nozzle and extending from the nozzle to a height less than the height of the chamber such that fluid coming from the nozzle overflows into the chamber; a fluid return port near the lower end of the chamber and having one end of a return tube attached thereto; an external injection connection for receiving a second end of the return tube; and means within the housing for conducting fluid from the injection connection to the bearings and seals.

The foregoing and other aspects will become apparent from the following detailed description of the invention when considered in conjunction with the accompanying drawings.

DETAILED DESCRIPTION

Centrifugal pumps are commonly made with an external connection lubricating port for the bearings and/or seals. Fluid is injected through the port to lubricate or cool internal parts. A passage through the housing conducts the flush fluid from the flush port to the wall of the shaft tunnel between the bearings. In pumps having an external drive motor, the seals between the motor drive shaft and the impeller housing are also kept moist and cooled by the flush fluid. In "canned pumps", such as those described here, dynamic shaft seals are not needed. In addition the back shroud (the face opposite the pumping vanes) is often provided with pump out slots or vanes. These pump out vanes provide axially balancing forces to the impeller to reduce the net axial load on the impeller and its bearings.

Figure 1:
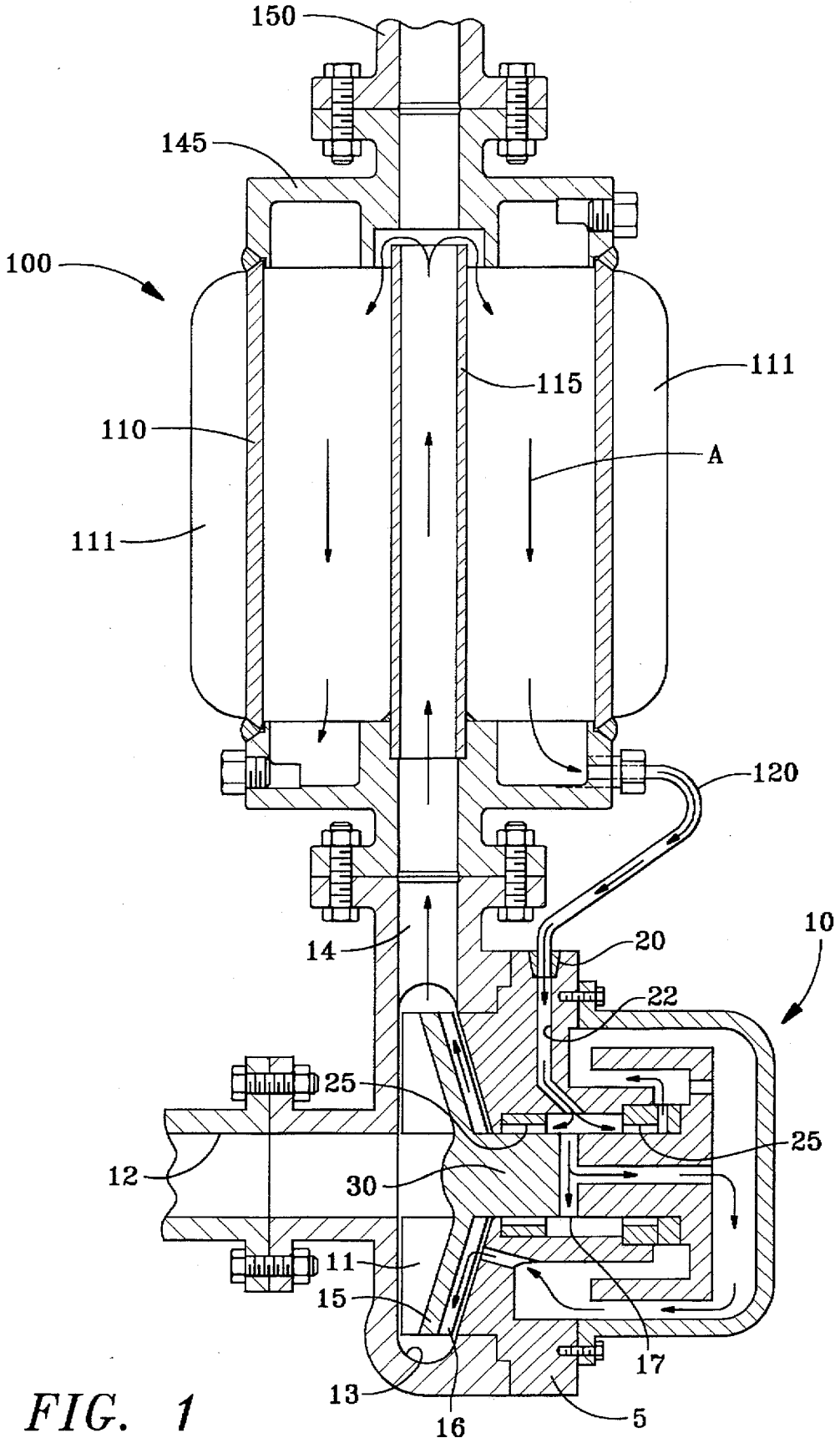
FIG. 1 is a schematic cross-sectional elevation view of a centrifugal pump with bearings incorporating the percolator of the invention.

When a centrifugal pump pumps the liquid from the liquid source at a rate greater than the replenishment rate of the liquid to the source, the pump may run dry for several minutes until either the pump is turned off or the liquid supply to the source is replenished. The function of such a pump 10 and the operation of the present invention will be described with reference to FIG. 1; and the application to a pump with a horizontal discharge will be described with reference to FIG. 2, in which the same numbers are used to designate the same features in both Figures. During dry running, the suction pipe 12, the inlet nozzle 5, the eye of the impeller 15, and most of the pumping vanes 11 become void of liquid except for a torus 13 of liquid which remains in the volute surrounding the impeller 15 while the pump 10 is running. The torus 13 of liquid only produces a small pressure head (1–2 feet, at 3500 rpm, for a 6 in. diameter pump), and even though there is a passage from the torus 13 to the bearings 25, there is a negative pressure drop in that direction which cannot be overcome during dry running. Since the small pressure head can force liquid through the discharge nozzle 14, it follows that a supply of liquid is available for bearing lubrication and cooling.

The percolator 100 of the present invention comprises a pot 110 mounted on the discharge nozzle 14; the pot 110 having a percolator cover 145, connected to discharge pipe 150, and cooling fins 111 for dissipating frictional heat absorbed by the pumped fluid during running of pump 10. A percolator tube 115, having a diameter at least as great as that of the discharge nozzle 14, extends from the discharge nozzle to a point below the percolator cover 145 such that the liquid head is sufficient to cause overflow of liquid from the percolator tube 115 into the pot 110. A fluid return tube 120 leads from a return port near the bottom of the pot 110 to an external injection connector 20 on the pump housing 5. Fluid fed to the external injection connection 20 by fluid return tube 120 travels through an internal passage 22 within the housing 5 to an outlet in the wall of the shaft tunnel 17 between the bearings 25. The fluid flows through the bearings 25 supporting the shaft 30 and into the pumping chamber behind the impeller 15 and from there to the torus 13. Preferably, the back face of the impeller shroud is equipped with pump out vanes or slots 16, which provide the pressure gradient necessary to maintain flow of the fluid through the fluid return tube 120, the external injection connection 20, the internal passage 22, the bearings 25, and the pumping chamber space behind the impeller 15 to the torus.

In operation, the liquid torus 13 has sufficient head to carry liquid through the discharge nozzle 14 and the percolator tube 115 so that it overflows, in the circulation path "A" indicated by the arrows, into the pot 110 and maintains a reservoir of pumped fluid which is cooled in the pot. The fluid return tube 120 receives fluid from a return port near the bottom of the pot 110 and conducts it to the external injection connection 20 on the pump housing 5. The fluid then flows through an internal passage 22 to the wall of the tunnel 17 between the bearings 25 which support shaft 30. From there, the fluid flows through the bearings 25, a portion of the fluid, in some cases, returning directly to the pumping chamber behind the impeller 15 and the remainder, in such cases, traveling through the housing 5 to extract induction heat. During normal operation, the fins 111 on the percolator pot can dissipate sufficient heat to provide adequate cooling.

Figure 2:
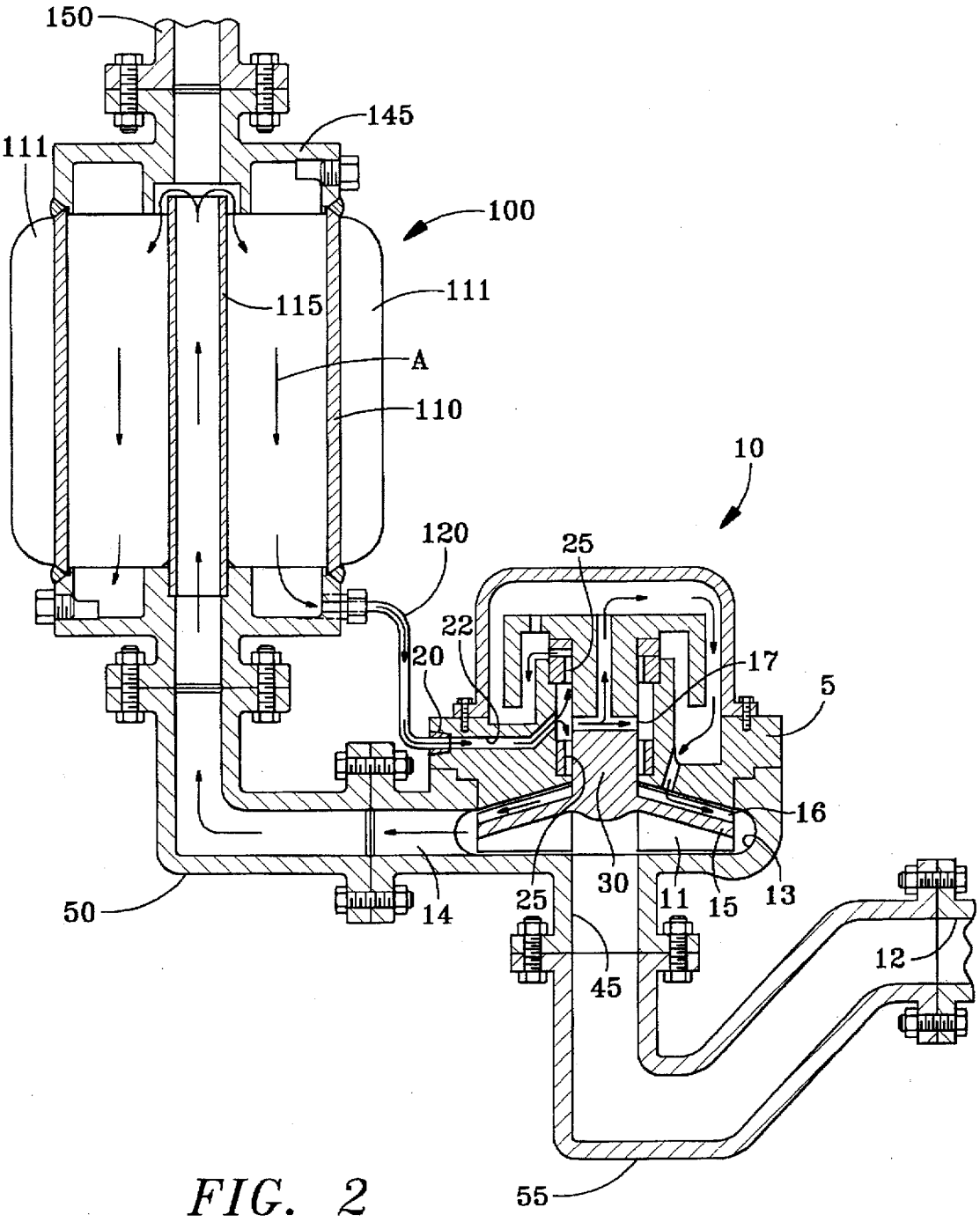
FIG. 2 is a schematic, as in FIG. 1, illustrating the percolator of the invention as applied to a pump with a horizontal discharge.

In FIG. 2, the torus 13 is horizontal as is the discharge nozzle 14, while the inlet nozzle 45 is vertical as is the shaft 30 which carries the impeller 15. In order to accommodate the horizontal discharge of this embodiment, it is merely required to provide an elbow 50 between the discharge nozzle 14 and the percolator tube 115 within the percolator 100. Depending upon the supply of liquid to the suction pipe 12, it may also be necessary to provide an elbow 55, between the suction pipe and the pump inlet 5. Thus, the percolator 100 can be applied to pumps of any orientation by insertion of appropriate elbows to redirect the discharge and inlet nozzles of such pumps so that they discharge vertically upward regardless of the direction of the suction pipe or the pump housing discharge, as seen in FIG. 2.

This invention provides the advantage of being amenable to retrofit applications. In pumps equipped with the external injection connection 20, the internal passage 22, and, preferably, the pump out slots 16 on the impeller shroud, it is only necessary to interpose the percolator 100 between the pump discharge nozzle 14 and the discharge pipe 150 and install the fluid return tube 120 between the percolator pot 110 and connection 20 to have a fully percolation protected system. For externally driven pumps, the shaft seals are cooled and lubricated by the recirculated fluid, so that brief periods of dry running do not destroy them. This can significantly extend the lives of such pumps.

Having described the invention, we claim:

1. A percolator system for providing fluid flow to mechanical seals and to bearings supporting a drive shaft, on which is mounted an impeller having pumping vanes and at least a back shroud, disposed within a housing of a centrifugal pump, during intermittent dry running periods, said pump having a discharge nozzle, comprising:

a chamber having a lower end attached to said discharge nozzle and an upper end attached to a discharge pipe, said chamber having an inside diameter greater than an outside diameter of said discharge, and said chamber further having an internal percolator pipe at least equal in diameter to the discharge and extending from said discharge to a height less than the height of the chamber such that fluid coming from said nozzle discharge overflows into the chamber;

a fluid return port near the lower end of said chamber and having one end of a return tube attached thereto;

an external injection connection on the pump housing for receiving a second end of said return tube;

means within said housing for conducting fluid from said injection connection to said bearings and seals; and means for pumping said fluid from said bearings and seals to a torus surrounding said impeller.

2. The percolator according to claim 1, wherein the means within said housing for conducting fluid from said injection connection to said bearings and seals comprises an internal bearing and seal lubrication passage through said housing.

3. The percolator according to claim 1, wherein the means for pumping said fluid from said bearings and seals to a torus surrounding said impeller comprises pump-out means on a face of the impeller back shroud opposite said pumping vanes.

4. The percolator according to claim 3, wherein the pump-out means on a face of the impeller back shroud opposite said pumping vanes comprises a plurality of substantially radial slots which receive fluid at inboard ends from the bearings and discharge said fluid from outboard ends into said torus.

* * * * *